US011198072B2

(12) United States Patent
Waxkirsh

(10) Patent No.: US 11,198,072 B2
(45) Date of Patent: Dec. 14, 2021

(54) TOY DEVICE FOR DISPENSING STACKABLE OR ROLLABLE MATERIALS AND RELATED METHODS

(71) Applicant: GW DEVELOPMENT UK LIMITED, London (GB)

(72) Inventor: Gavin Waxkirsh, London (GB)

(73) Assignee: GW DEVELOPMENT UK LIMITED, London (GB)

( * ) Notice: Subject to any disclaimer, the term of this patent is extended or adjusted under 35 U.S.C. 154(b) by 0 days.

(21) Appl. No.: 16/790,060

(22) Filed: Feb. 13, 2020

(65) Prior Publication Data

US 2020/0338466 A1 Oct. 29, 2020

Related U.S. Application Data

(63) Continuation of application No. PCT/GB2018/052299, filed on Aug. 13, 2018.

(30) Foreign Application Priority Data

Aug. 14, 2017 (GB) ..... 1713026

(51) Int. Cl.

| | |
|---|---|
| ***A63H 37/00*** | (2006.01) |
| ***A63H 29/24*** | (2006.01) |
| ***A63H 29/20*** | (2006.01) |
| ***A63H 33/00*** | (2006.01) |

(52) U.S. Cl.

CPC ..... *A63H 29/24* (2013.01); *A63H 29/20* (2013.01); *A63H 33/00* (2013.01); *A63H 37/00* (2013.01)

(58) Field of Classification Search

CPC ..... A63H 37/00; F41B 4/00

See application file for complete search history.

(56) References Cited

U.S. PATENT DOCUMENTS

| | | | |
|---|---|---|---|
| 1,207,669 | A | 12/1916 | Troubridge |
| 1,767,207 | A | 6/1930 | Gale |
| 1,992,085 | A | 2/1935 | Mckay |
| 2,766,989 | A | 10/1956 | Sivertson |

(Continued)

FOREIGN PATENT DOCUMENTS

GB 1365826 A 9/1974

OTHER PUBLICATIONS

BOOMCO. "BOOMco. Crank Force Blaster." Internet. Available at https://www.amazon.com/BOOMCODHV35BOOMcoCrankBlaster/dp/B014DEHE5M. Last accessed Jun. 16, 2017.

(Continued)

*Primary Examiner* — John A Ricci

(74) *Attorney, Agent, or Firm* — United IP Counselors, LLC

(57) ABSTRACT

A toy device for dispensing stackable or rollable materials and related methods are described. The device has a housing arranged to contain a stack or roll of material and having a dispensing aperture. A manually actuated drive mechanism is provided by which a user can rotate a drive wheel of the drive mechanism. The drive wheel contacts and when rotated engages a portion of the material and to drive it through the dispensing aperture. A release mechanism is provided that can be moved to allow the material to be driven through the aperture. The drive mechanism can be actuated independently from the release mechanism.

18 Claims, 10 Drawing Sheets

(56) References Cited

U.S. PATENT DOCUMENTS

| | | | | |
|---|---|---|---|---|
| 2,794,391 | A | 6/1957 | Kafka | |
| 3,147,978 | A | 9/1964 | Emanuel | |
| 3,517,855 | A | 6/1970 | Hillis | |
| 4,569,461 | A | 2/1986 | Orr | |
| 4,750,743 | A | 6/1988 | Nicoletti | |
| 4,875,459 | A | 10/1989 | Elderen et al. | |
| 5,119,969 | A | 6/1992 | Haber | |
| 5,134,957 | A * | 8/1992 | Nobili | A45D 40/0087 118/235 |
| 5,261,563 | A | 11/1993 | Brimhall | |
| 5,382,024 | A | 1/1995 | Blaha | |
| 5,384,003 | A | 1/1995 | Mitchell | |
| 6,299,018 | B1 | 10/2001 | Kimbrell | |
| 7,121,499 | B2 | 10/2006 | Lammers et al. | |
| 7,195,049 | B2 | 3/2007 | Downs et al. | |
| 7,845,515 | B2 * | 12/2010 | Moody | A47K 10/424 221/36 |
| 8,083,568 | B2 | 12/2011 | Reiss | |
| 9,189,908 | B2 | 11/2015 | Sampson et al. | |
| 9,207,035 | B2 | 12/2015 | Schexnayder | |
| 2013/0312722 | A1 | 11/2013 | Price | |
| 2014/0217111 | A1 | 8/2014 | Sampson et al. | |
| 2016/0030831 | A1 | 2/2016 | Stasson et al. | |

OTHER PUBLICATIONS

DDL Wiki. "Automatic Card Shuffler Opportunity." Internet. Available at https://wiki.ece.cmu.edu/ddl/index.php/Automatic_card_shuffler_opportunity. Last accessed Jun. 15, 2017.

International Search Report issued in International Application No. PCT/GB2018/052299 dated Oct. 29, 2018.

Kwasmo Enterprises LLC. "The Cash Blaster." Internet. Available at https://www.kickstarter.com/projects/1036178856/thecashblaster Last accessed Jun. 15, 2017.

LOBOCNC, "Playing Card Shooter." Internet. Available at https://www.thingiverse.com/thing:961084. Aug. 8, 2015. Last accessed Jun. 16, 2017.

Written Opinion issued in International Application No. PCT/GB2018/052299 dated Oct. 29, 2018.

* cited by examiner

TOY DEVICE FOR DISPENSING STACKABLE OR ROLLABLE MATERIALS AND RELATED METHODS

CROSS-REFERENCE TO RELATED APPLICATIONS

This application is a continuation of PCT International Patent Application No. PCT/GB2018/052299, filed Aug. 13, 2018, which claims priority to GB1713026.1, filed Aug. 14, 2017. Both of those applications are incorporated by reference herein in their entireties.

TECHNICAL FIELD

The present invention relates to a toy device for dispensing stackable or rollable materials and related methods.

BACKGROUND

Various devices for dealing cards and the like are known for playing card games and board games. Other toy and novelty devices are known to fire cards, bank notes, foam disks/darts and other projectiles.

Typically, these are powered electronically, requiring batteries, PCBs, motors etc. to power the mechanism used to dispense the material. Actuation of a button activates the motor which powers a drive wheel which in turn engages with and dispenses a card or tape from the device, e.g. U.S. Pat. No. 7,121,499. In some examples, actuation of the button simultaneously releases a brake mechanism as well as activating the motor, allowing it to be driven out of through the dispensing aperture. However, such arrangements give only limited control over the speed at which cards are dispensed. Use of electronics and batteries also makes them less environmentally attractive, as well as adding expense to the manufacturing process, and inconvenience to the user in managing recharging/replacement batteries.

Some manually operated devices are known in the toy industry for firing projectiles such as darts and other projectiles at high velocities, e.g. such as U.S. Pat. No. 8,083,568B2 and U.S. Pat. No. 6,299,018B1. These may involve a hand crank for driving a drive wheel at high rotational speed through appropriate gearing, and a trigger mechanism for dropping an individual projectile into a firing cavity where it contacts the rotating drive wheel such that it is fired from the device. Again, this provides poor control of the speed and rate at which projectiles are dispensed. Attempting multiple releases in quick succession is problematic if not impossible as jamming of the device is to be expected if several projectiles were released into the firing cavity in quick succession and in a largely uncontrolled manner.

What is needed is an improved dispenser of such materials that mitigate these problems in known devices.

BRIEF SUMMARY

According to a first aspect of the present invention, there is provided a device a toy device for dispensing stackable or rollable materials, comprising: a housing arranged to contain a stack or roll of material and having a dispensing aperture; a manually actuated drive mechanism by which a user can rotate a drive wheel of the drive mechanism, the drive wheel being arranged contact and when rotated engage a portion of the material when contained in the housing so as to drive the material through the dispensing aperture to dispense it; an release mechanism comprising a movable element having a first position where it prevents the material from being driven through the aperture and movable to a second position to allow the material to be driven through the aperture, and having an actuator linked to the movable element arranged to move the element between the first and second positions upon actuating by a user, wherein the drive mechanism can be actuated independently from the release mechanism.

This arrangement allows cards, notes, bills, tokens, streamers, coupons, ribbons and other chartaceous, thin materials in a stacked or reeled form to be dispensed in a controlled way by the user by manually cranking the drive mechanism leading to the desired speed building up in the drive wheel. When the user is ready, the stop element is moved out of the way via actuation of the actuator, such that the drive wheel drives the material from the housing through the aperture. The independent nature of the drive mechanism and the release mechanism means that the speed and frequency at which the material is dispensed can be easily controlled by the user. In the case of stacked material, the items can be dispensed at a rapid rate by keeping the release mechanism actuated, whilst, in some embodiments, continuing to crank the drive mechanism. In other embodiments, energy storage devices are included in the drive mechanism to allow cards to be dispensed after user actuation has ended. Alternatively, the user can decide to dispense items by discrete actuations of the release mechanism in a more controlled manner, allowing for instance the device to be aimed each time so that the items are differently directed.

The materials dispensed are generally "chartaceous", i.e. "thin", smooth materials that form a stack or roll. For example paper, card, and thin plastic or foam elements or rolls may be dispensed. Whilst there is not well defined upper limit on the thickness of materials to be dispensed, it is expected that in most applications, the materials will be less than 5 mm thick, and in many cases, the materials will be less than 1 mm thick, e.g. in the case of paper notes, conventional playing cards, etc. The drive wheel preferably relies on frictional contact with the material and may have a special high friction periphery so as to work with a wide variety of materials, without any special adaptation of the material being necessary.

Another advantage of the invention is that it is more environmentally friendly (no battery, PCB or motor used), lower priced, immediately playable out of the box, and on the crank driven version, the speed is directly controllable by hand rather than through a PCB, adding to the safety of the device.

A preferred embodiment is a crank driven hand held dispenser, which drives a series of gears in different ratio to build up speed & rotate a wheel, that fires out multiple notes or streams of said objects & material, when engaged by pressure against the drive wheel through pressing a trigger button. It can be either wind up crank or lever gear driven, requires no PCB or motor, and has more direct control by hand operation.

In an embodiment, the drive wheel is movable between a position where it contacts the material and a position where it does not contact the material, wherein the release mechanism is further arranged to move the drive wheel by way of the actuator such that when actuated by the user the drive wheel is moved into contact with the material and the movable element is moved to the second position allowing the material to be dispensed. Thus, the release mechanism both engages the drive wheel and removes the stop element, allowing material to be dispensed in a mechanically simple arrangement. The release mechanism may be biased in an initial position where the drive wheel is not engaged with the material and the stop element is blocking the aperture, such that the user is required to actuate the actuator, e.g. press a button, to release the materials and the release mechanism returns to its non-actuated state when the user ceases actuation. This might be accomplished by a spring or opposing the release mechanism, or by the weight of the elements of the release mechanism themselves biasing the release mechanism in the non-actuated position.

In an embodiment, the drive mechanism comprises a gear casing pivotally mounted in the housing containing gearing that translates rotation of a hand crank to rotation of the drive wheel, wherein the release mechanism when actuated by the user is arranged to pivot the gear casing such that the drive wheel makes contact with the material. This provides a convenient mechanism for moving the drive wheel into engaging position with the materials.

In an embodiment, the gear casing is arranged to pivot about the axis about which the hand crank rotates. Thus, the drive wheel can be moved into position by pivoting the gear casing without affecting the user cranking the device.

In an embodiment, the drive wheel is in fixed position and arranged to slip against the material when the movable element is in the first position preventing the material from being driven through the aperture until the moveable element is moved.

In an embodiment, the drive wheel has a rubberised or high friction periphery for gripping the material.

In an embodiment, the device comprises an element for biasing a portion of the material against the driving wheel.

In an embodiment, the release mechanism comprises a lever pivotably attached relative to the housing, having the actuator fixed to one end of the lever at a position outside the housing and the movable element at the other end of the lever. In an embodiment, the lever is arranged to also move the gear casing. Thus, a lever arrangement can provide a simple and convenient mechanical mechanism for the release mechanism which is simple to manufacture and operate.

In an embodiment, the drive mechanism comprises a hand crank or lever by which the user actuates the drive mechanism.

In an embodiment, the drive mechanism comprises gearing to increase the speed of the drive wheel.

In an embodiment, the drive mechanism comprises a flywheel.

In an embodiment, the drive mechanism comprises a spring arranged to store energy upon user actuation of the drive mechanism and release the energy to the drive wheel.

In an embodiment, the housing comprises a handle and the actuator is positioned to be actuatable by a digit of the user's hand when holding the handle in that hand. Thus, one hand holds and triggers the device, whilst the other hand cranks the device.

In an embodiment, the device has a lid, which is openable to allow access to the interior of the housing for loading a stack or roll of material to the device. The device may have an arm that biases the materials against the drive wheel. The lid and arm may be pivoted to the housing and the arm may have a portion that extends through an aperture or recess in the lid such that lifting the extending portion lifts both the arm and lid to allow materials to be loaded to the device.

In an embodiment, the device comprising an edge feature adjacent the aperture by which a dispensed portion of the material may be torn or cut.

In an embodiment, the drive mechanism comprises a slip clutch to prevent damage to the drive mechanism from overly forceful user actuation of the drive mechanism.

In an embodiment, the release mechanism is biased with the stop element in the first position, such that user actuation is required to move it to the second position and the biasing force returns it to the first position upon cessation of user actuation.

In an embodiment, the device comprising a tape or stack of material loaded within the housing, wherein the material is paper, card, plastics, foam or the like.

In an embodiment, the device comprising an adaptor reversibly attached to the housing to position materials of a different size. Thus, the device can be adapted to different sizes and shapes of materials by including an adaptor that positions the material so they make contact with the drive wheel.

According to a second aspect of the present invention, there is provided a method of dispensing material using the device described above, comprising:

loading a stack or reel of material to the device;

manually actuating the drive mechanism to attain a desired speed of the drive wheel;

actuating the release mechanism to allow material to be driven through the aperture.

In other aspects, the invention extends to a dispenser for stackable or rollable materials, comprising: a housing arranged to contain a stack or roll of material and having a dispensing aperture; a drive mechanism comprising a drive wheel rotatable upon user actuation of the drive mechanism; and a release mechanism that, when actuated by a user, moves the drive wheel to contact and when rotated engage a portion of the material when contained in the housing so as to drive the material through the dispensing aperture to dispense it. The drive wheel may be moved by moving a gear casing containing a gear train by which the drive wheel is rotated. The drive wheel may be moved against a biasing force, either a spring or the weight of elements of the release mechanism or drive mechanism that move when the release mechanism is actuated. For instance, the gear casing may be pivoted by the release mechanism by the user pressing a button or trigger so that the drive wheel engages with the material. The gear casing may be hand cranked having an crank axis that coincides with a pivot about which the gear casing pivots to the housing such that the release mechanism and actuation mechanism may be actuated independently without affecting one another.

BRIEF DESCRIPTION OF THE DRAWING FIGURES

Embodiments of the present invention will now be described by way of example with reference to the accompanying drawings, in which.

DETAILED DESCRIPTION

Figure 1:
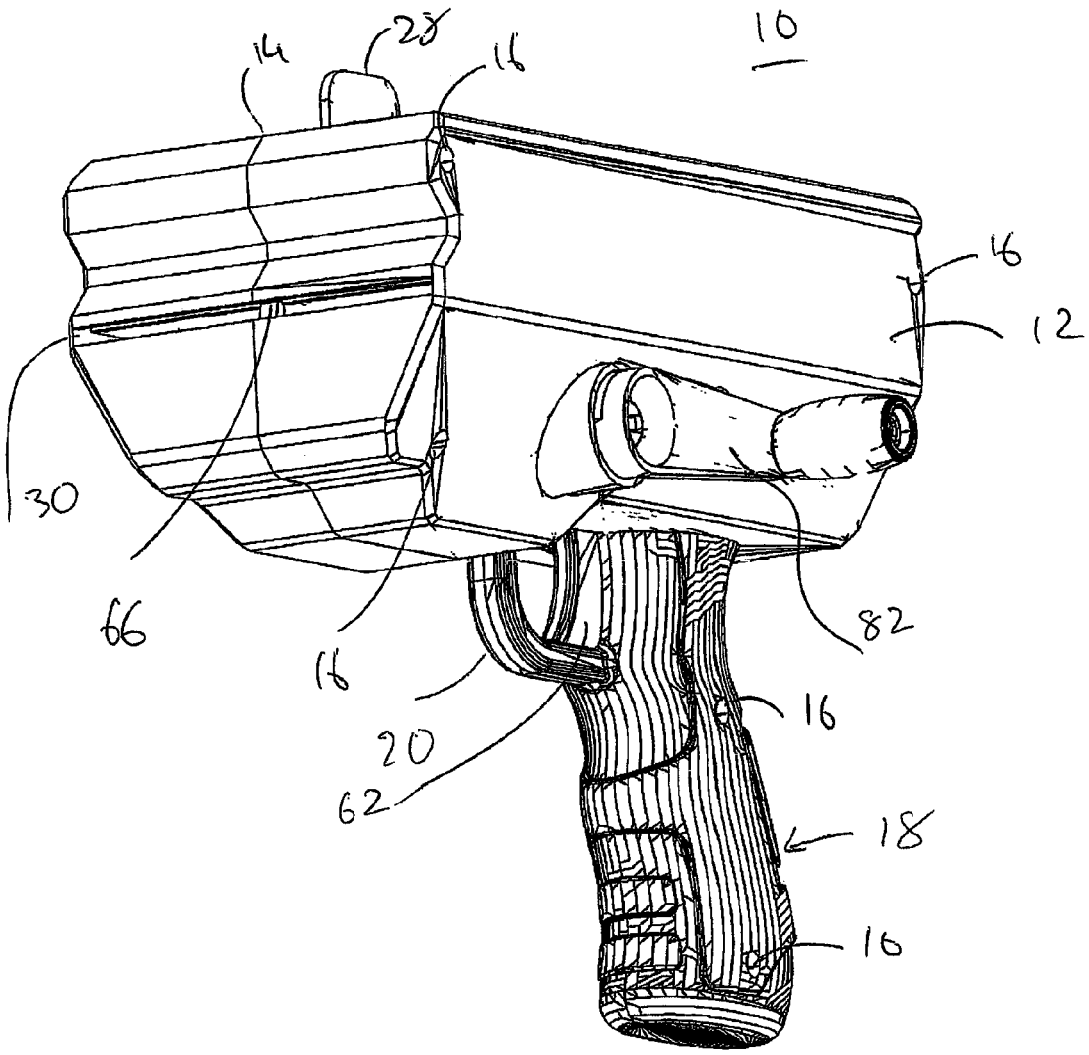
FIG. 1 shows a perspective view from the front, left and bottom of an example of a card dispenser according to an embodiment of the present invention.
Figure 2:
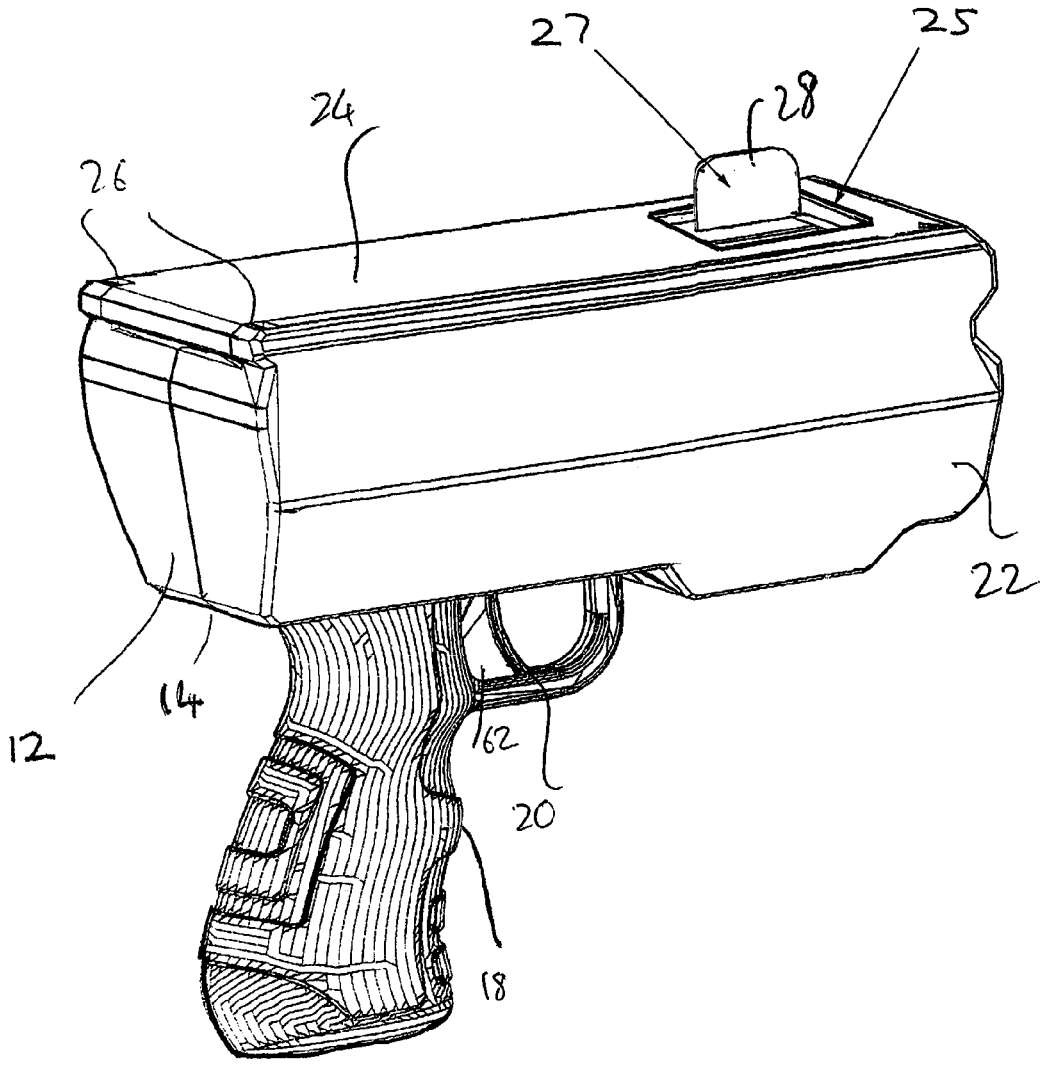
FIG. 2 show the card dispenser of FIG. 1 from the rear, right and top.

FIGS. 1 and 2 shows an embodiment of a toy device for dispensing stackable or rollable materials, which in this example takes the form of cards, such as playing cards.

The device 10 comprises a housing 12 that generally acts to encase partially or fully and/or support and position at least some other components of the device. As will be described below in more detail in relation to FIGS. 3 to 9, the device 10 also has a release mechanism 60 and an actuation mechanism 80.

In this example the housing 12 is a two piece plastics housing that joins along a vertical plane 14 of the device using screw fasteners 16. It will be appreciated that other suitable forms for manufacturing the housing may be employed.

In this example, the device is shaped in a gun-like form. The housing 12 provides a handle portion 18 by which the device may be held in the hand by a user. This may be provided with a grip surface or over moulded with a rubber grip as required. The housing 12 also has a trigger surround portion 20 positioned such that a trigger 30 within the trigger surround portion 20 as part of a release mechanism 80 (shown below) can be actuated by the user's finger when holding the device by the handle portion 18.

Figure 3:
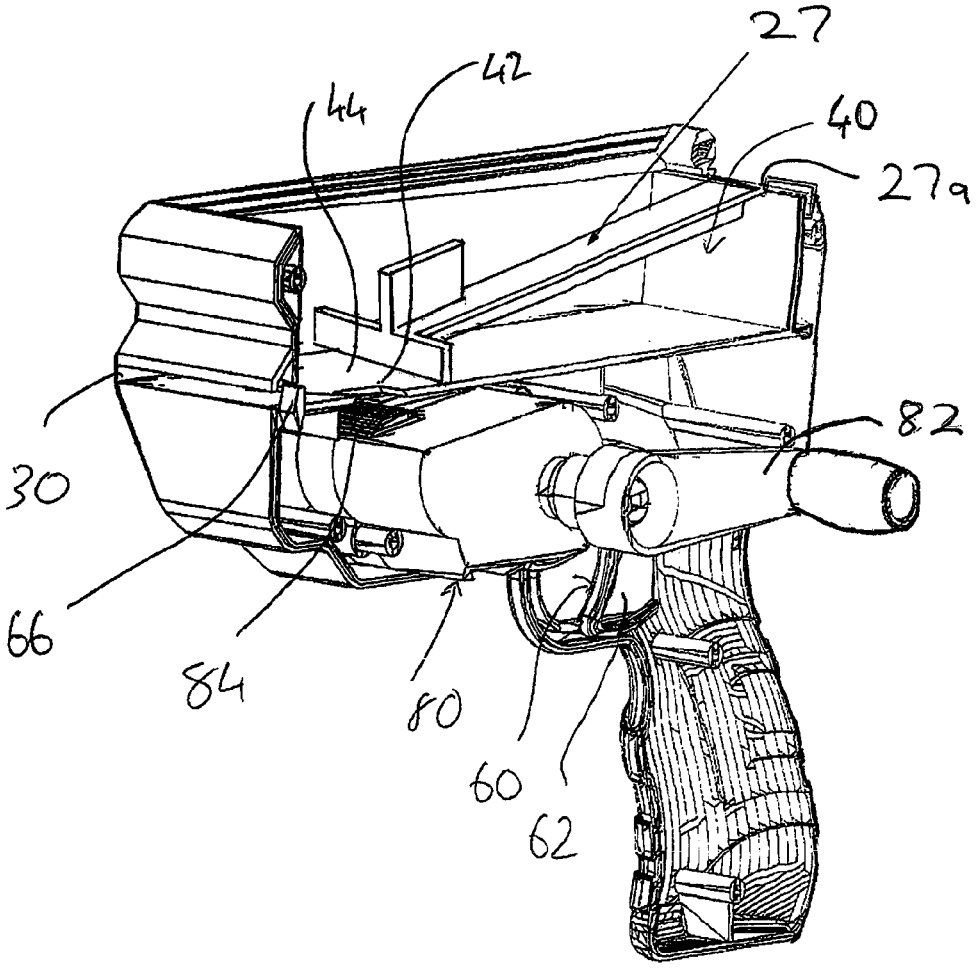
FIG. 3 shows the card dispenser of FIG. 1 with a portion of its housing removed.

The housing also has a main body portion 22 atop the handle portion 18 which contains a firing cavity 40 (shown in FIG. 3) in which the chartaceous materials are stowed, and elements of the actuation mechanism 80 and a release mechanism 60 (described below). The top surface of the body portion has a lid 24 which is movable to allow access to the firing cavity to allow materials to be loaded to the device. In the present example, the lid 24 has pivoted connections 26 to the main body of the housing at the rear. A biasing arm 27 is provided below the lid also having a pivoted connection 27*a* to the main body of the housing at the rear and an upwardly projecting tab 28 which extends through an aperture 25 in the top surface of the lid 24. Thus, the user can pull on the tab 28 allowing the lid 24 and arm 27 to be lifted for gaining access to the firing cavity 40 to load the device. As shown in FIG. 3, the biasing arm can pivot down inside the firing cavity 40 to provide a compressive force to the stack of cards in the firing cavity 40, through its own weight and/or through the biasing force of a spring (not shown).

The device has a crank 62 which projects from a side of the main body portion 22 as part of the actuation mechanism 60. As will be described, with the crank turned 62 by the free hand of the user, depressing the trigger 30 causes cards to be dispensed from the body 22 of the device via an aperture 30 at the front of the device 10.

Figure 4A:
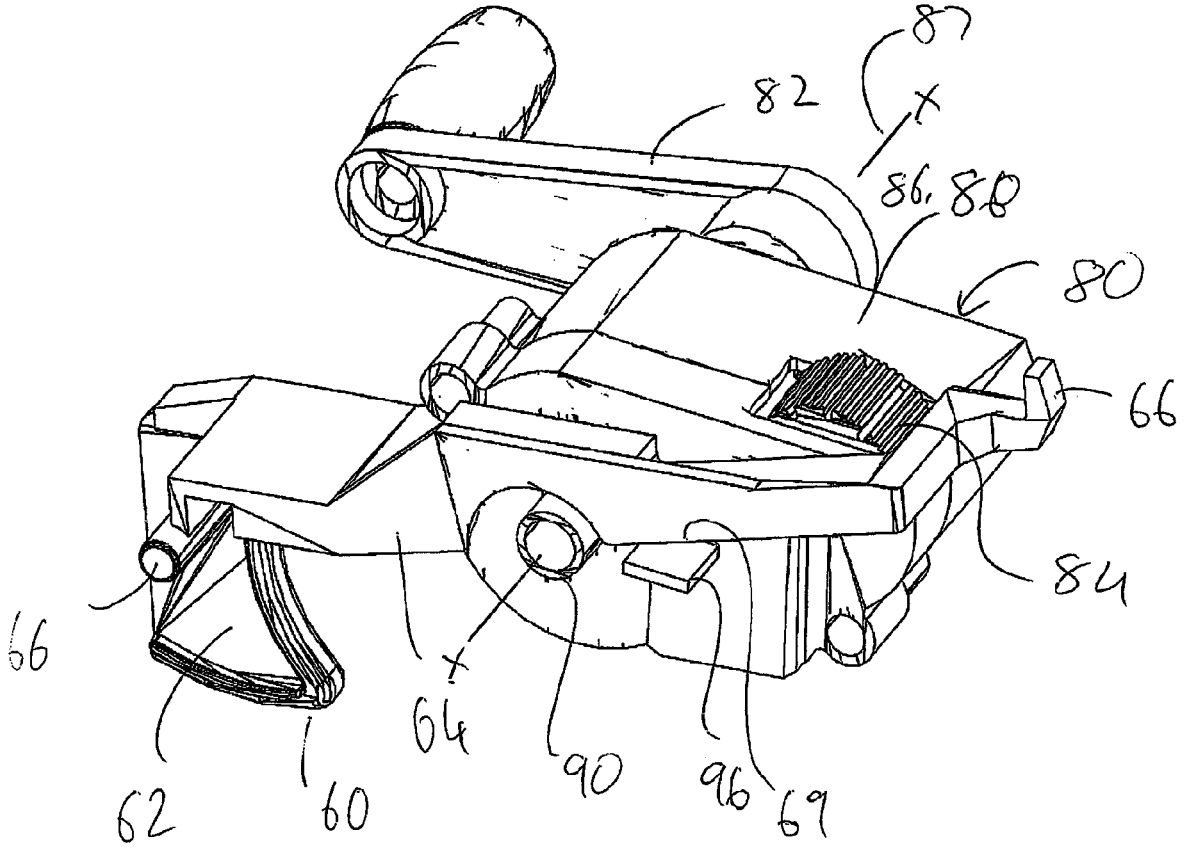
FIG. 4A shows an example of an activation and release mechanism for the card dispenser in isolation and FIG. 4B shows the mechanism from the reverse angle.
Figure 4B:
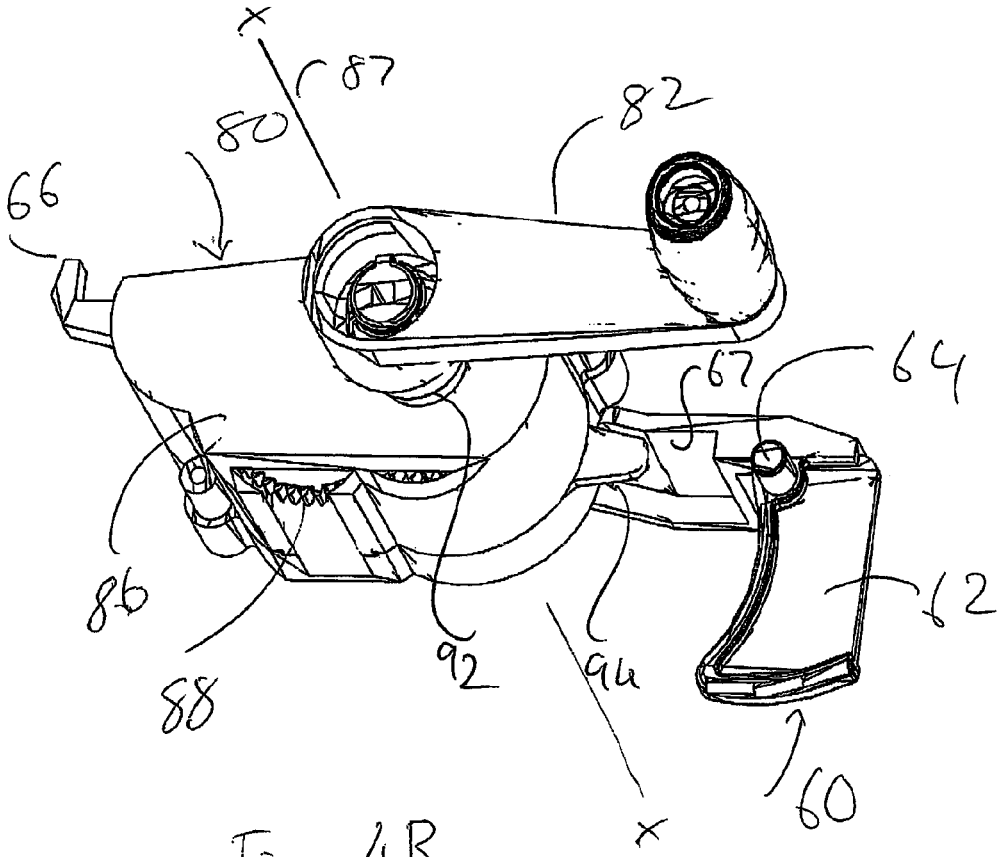
Figure 5:
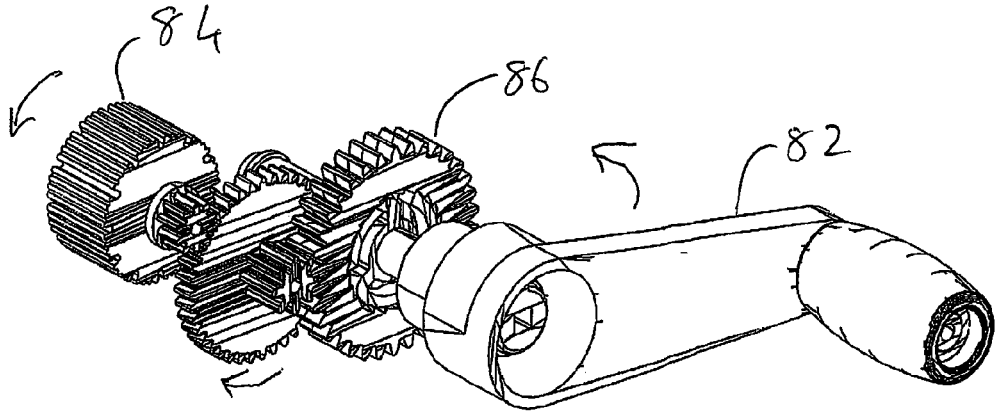
FIG. 5 shows the activation mechanism in isolation with its casing removed.

FIG. 3 shows the device 10 with half of the housing removed on the side of the crank 82 showing the activation mechanism 80 and release mechanism 60 inside. FIGS. 4A and 4B show the activation mechanism 80 and release mechanism 60 in isolation from reverse angles. The activation mechanism 80 comprises the crank 82 which turns a drive wheel 84 via a gear train 86 contained in a gear casing 88. FIG. 5 shows the activation mechanism 80 without the gear casing 88 showing the gear mechanism 86. A gear ratio of between 10× and 30× may be used to achieve desired dispensing speeds, e.g. 0.5 to 3 m/s via moderate hand cranking of the device, e.g. 0.5 to 3 revolutions/s with a moderate sized drive wheel (e.g. 1.5 cm diameter). A slip clutch (not shown) may be provided in the gear train 86 to prevent over cranking causing damage to the gear train.

The gear casing 88 is arranged to pivot in the housing 12 of the device 10 about the axis 87 about which the crank 82 rotates. To achieve this, the gear casing 88 may have pivot features, e.g. cylindrical projections/axles, on either side aligned with the axis 87. These cylinders 90,92 are received by holes or other suitable shaping in the housing 12 (not specifically shown) of the device, such that the gear casing 88 can pivot about the cylinders 90,92. The crank shaft passes through the cylinder on one side into the gear casing 88 so that the gear casing 88 is free to pivot whether or not the device is being cranked.

The drive wheel 82 may be provided with a friction surface, e.g. rubberised, the upper surface of which protrudes into the firing cavity 40 through an aperture 42 in the bottom wall 44 of the firing cavity 40 provided by the housing 12 when the gear casing 88 is pivoted in a first position. Thus, the bottom most card in the cavity 40 rests on the upper surface of the drive wheel in this position, and as the crank is turned the drive wheel acts to urge the bottommost card towards the front aperture to dispense the card. As described below, the gear casing 88 can be pivoted to a second position where the drive wheel 82 is withdrawn from the cavity 40 so as not to make contact with the cards.

The release mechanism 60 comprises the trigger 62 connected to a lever 64 at the end of which is an upwardly projecting stop 66. The lever 64 is pivoted 66 to the housing 12 such that the trigger portion 62 is accessible to a user in the trigger surrounding portion of the housing and the stop 66 is positioned in the path between the firing cavity 40 and the aperture 30. Depressing the trigger moves the stop 66 downwards and out of the path.

As shown in FIG. 4B, the trigger 62 also operates to pivot the gear casing 88 into the first position by a surface 67 of the trigger arm 64 engaging a projection 94 at the back of the gear casing, so as to depress the rear of the gear casing and via the pivot 90,92 raise the front of the gear casing and drive wheel to engage the cards. As shown in FIG. 4A, the gear casing 88 has a projecting stop 96 which bears against a surface of the trigger arm 64 as the trigger 62 is depressed, thus providing a limit to the amount the gear casing can pivot and so precisely controlling the position of the drive wheel in the card engaging position when the trigger is depressed.

The trigger 62 may be depressed against the bias of a spring (not shown) to return the release mechanism 60 to the non-activated position when the trigger is released. Alternatively or additionally, depressing the trigger 62 to pivot the gear casing 88 may work against the weight of the gear casing and other components of the actuation mechanism 80, which create a moment to return the release mechanism to the non-activated position when the trigger is released. The direction in which the crank is turned to dispense cards may also be selected such that forces arising through the interaction of the mechanism with the gear casing tends to pivot the gear casing to the non-activated position, so as to avoid the possibility of cranking the device inadvertently operating the release mechanism.

Figure 6:
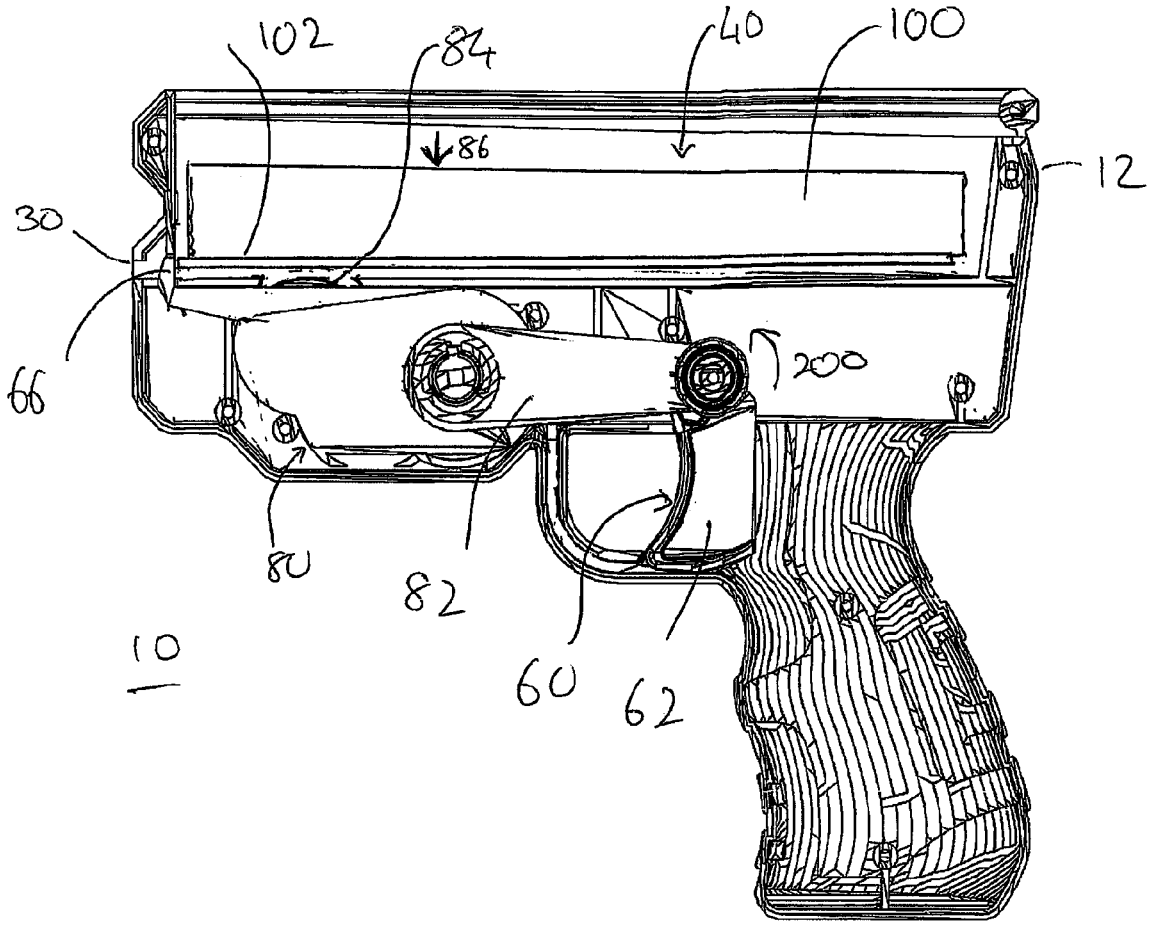
FIG. 6 shows a left plan view of the card dispenser with a portion of its housing removed, loaded with cards prior to activation.
Figure 7:
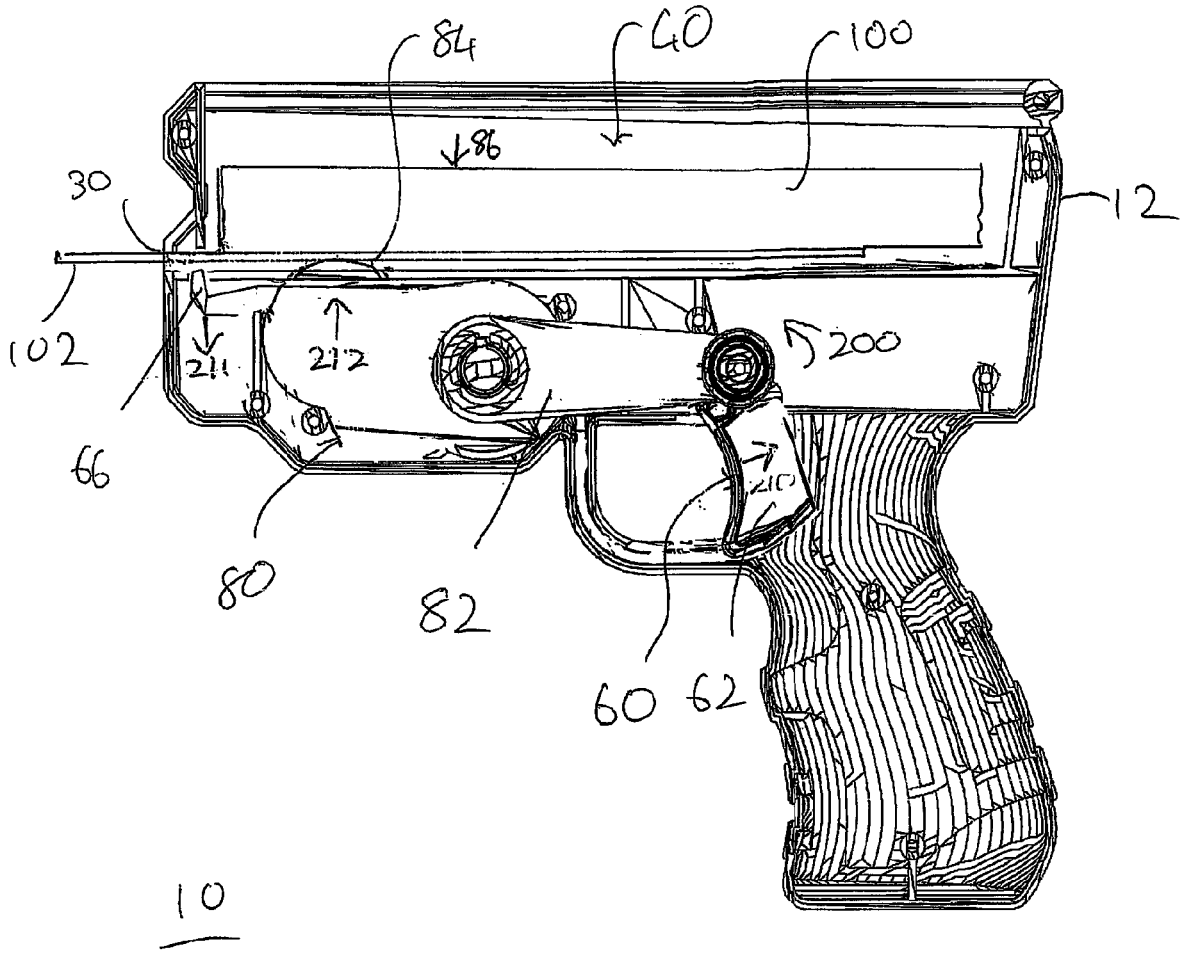
FIG. 7 shows a left plan view of the card dispenser with a portion of its housing removed, part way through activation.

FIGS. 6 and 7 show a card being dispensed by the device. Initially, as shown in FIG. 6, a stack of cards 100 are loaded into the firing cavity 40 as previously described. The biasing arm 27 provides a compressive force 86 to the top card, preferably close to the drive wheel 84. In the neutral position of the release mechanism 60, the stop 66 is positioned in the path between the bottommost card 110 and the aperture 30 in the housing 12 to prevent cards from passing through the aperture 30 until the device is triggered, and the gear casing is pivoted such that the drive wheel 84 is positioned below and out of contact with the bottommost card 110. The user begins the turn 200 the crank 82 to bring the drive wheel 84 up to speed, whilst in this position it does not contact the bottommost card 110.

As shown in FIG. 7, the user then activates the release mechanism 60 by depressing 210 the trigger 62. The lever 64 pivots the release mechanism 80 such that the drive wheel 84 makes contact (212) with the bottommost card 110 and pivots (211) the stop 66 out of the way, freeing the bottommost card 110 to be driven out of the dispensing aperture 30 by the drive wheel 84. The biasing arm 27 (not shown for clarity) helps keep good contact between the cards and the drive wheel such that the required frictional force can develop to drive the cards.

Once the bottommost card 110 is past the drive wheel 84 and substantially out of the aperture 30, the new bottommost card then comes into contact the drive wheel 84 and begins to be driven out of the aperture 30, and so on. The drive wheel 84 is preferably positioned toward the front of the cavity 40 so that one card 110 is out or nearly out of the firing cavity 40 before the next card from the stack 100 comes into contact with the drive wheel 84. Thus, a quick succession of cards 110 can be dispensed as long as the trigger 62 is depressed at a speed that is readily controllable by the user by way of the hand crank 82. Alternatively a single cards 110 can be dispensed at a time.

Thus, the device 10 provides a simple mechanical way of dispensing one or more cards in a continuous stream with fine control of the speed and release of the cards.

To further simplify the mechanism, the stop 66 could be removed, at the risk of cards falling out of the device if pointed downwards. Alternatively, a different mechanism could be used to move the drive wheel into contact with the cards when the trigger is depressed, e.g. the casing or drive wheel could be made to slide, etc. In some examples, the drive wheel 84 may not move at all, but will be permanently in contact with the cards. The frictional properties of the drive wheel 84 may be carefully chosen in conjunction with any biasing force 86 to allow slip between the wheel 84 and the card 110 whilst the stop 66 holds the card 110 in place, but to drive the card 110 out of the device when the trigger 62 is depressed moving the stop 66.

In the above examples, the weight of the biasing arm 27 helps give rise to the necessary frictional force with the drive wheel 84 to drive the cards. Alternatively, an additional biasing force may be employed (not shown), for instance an additional weight, the weight of the lid, or a resilient biasing element bearing on the topmost card in the stack 100 or any combination thereof to help create the desired frictional force between the material and the drive wheel 84. In other examples, the weight of the card or cards in the stack 100 alone may be sufficient to develop the necessary frictional force with the drive wheel 84.

In other examples, the activation mechanism 80 may include a spring which is wound up by the crank 82. A ratchet may be provided to prevent the spring unwinding through the crank 82 and instead releasing energy through to the drive wheel 84. Thus, the user may crank the device 10 to the desired speed corresponding to the amount of energy stored in the spring, stop cranking the device before releasing cards whilst the spring continues to deliver energy to the driving wheel 84. Alternatively or additionally, a flywheel can be added to the activation mechanism 80 to store energy to again allow the user to stop cranking the device before releasing cards. For instance, it is anticipated that the main components of the device 10 will be manufactured from plastics material, a metal flywheel may be coupled to the drive wheel or included in the gear mechanism.

In other examples, instead of a rotating crank, a lever driven mechanism may be used. Gearing may translate linear or rotational movement of the lever to a spring, which is arranged to drive the drive wheel. In principle, any mechanism for converting manual input from a user to rotate the drive wheel 84 can be used. In other examples, instead of a trigger, a button or other actuator can be provided to actuate the release mechanism.

Figure 8:
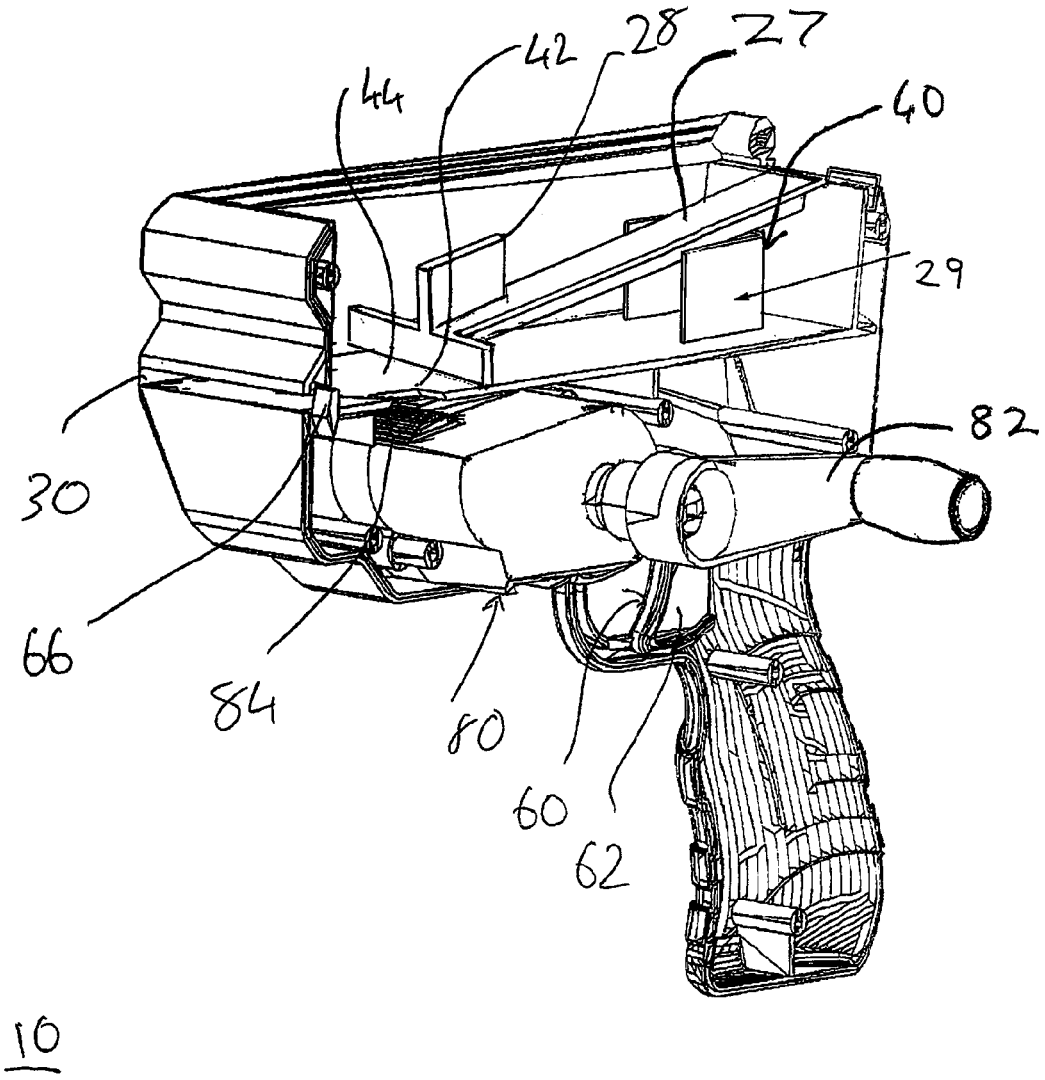
FIG. 8 shows a perspective view from the front, left and bottom of another example of a dispenser according to an embodiment of the present invention; and, FIG. 9 shows a perspective view from the front, left and bottom of another example of a dispenser according to an embodiment of the present invention.

A further example, as shown in FIG. 8, is similar to that of FIG. 1 but has an adaptor 29 for small materials which may be clipped-in or otherwise removably attached to the device in the firing cavity 40 to adapt the firing cavity 40 by way of its size, shape and/or position in the firing cavity to position and align a stack of smaller material, e.g. notes, cards, etc., than would fit in the firing cavity 40 without the adaptor. The adaptor 29 positions the smaller materials so they reach the driving wheel. Thus, by providing one or more different adaptors or allowing the adaptor to clip in to the cavity in different positions, the device can be made to work with a variety of sized materials.

The mechanism may be used to dispense a stack of paper tokens, leaflets, bank notes, cards, or any relatively thin, stackable items.

Figure 9:
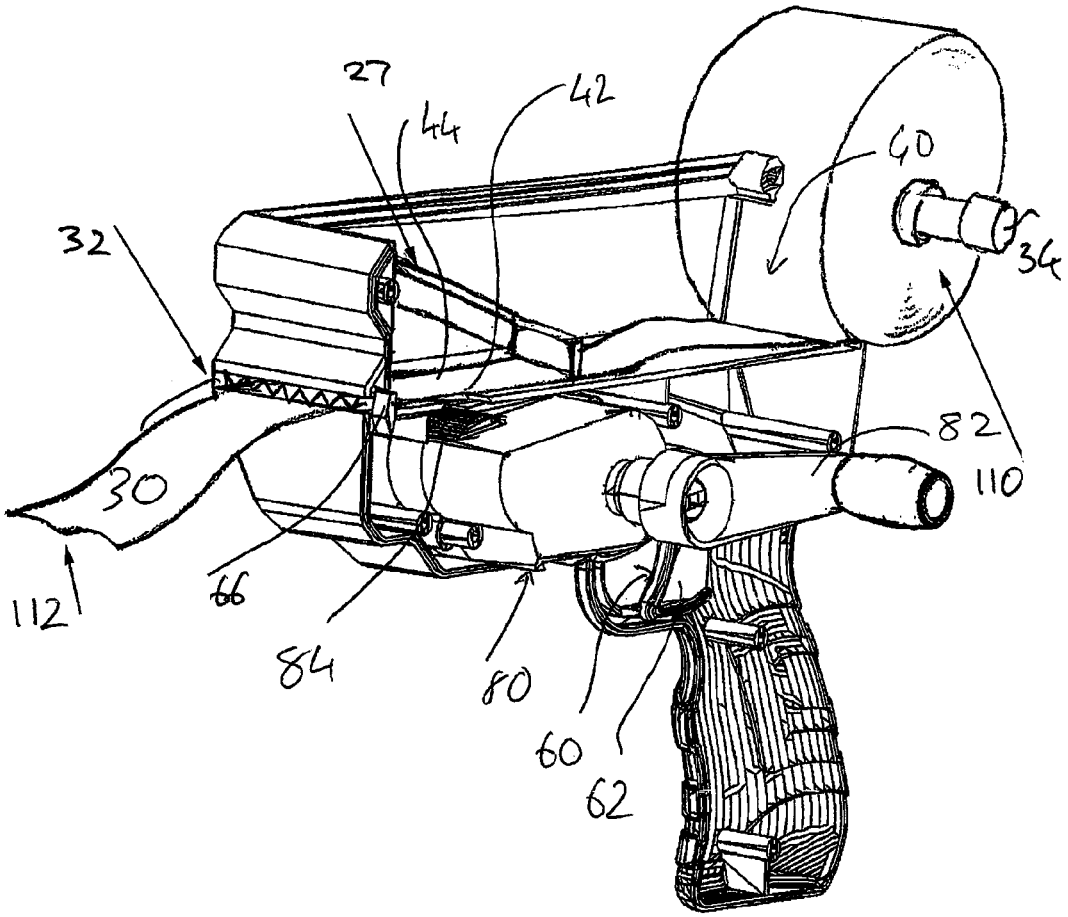

In other examples, the mechanism may be used to dispense chartaceous material from a roll instead of a stack. For example, as shown in FIG. 9, the firing cavity is adapted to hold a roll of material 110 and allow it to rotate, whilst maintaining the bottommost surface of the roll in contact with the driving wheel. In the present example, the device has a rotatable axle or spindle 24 mounted to the housing 12 for holding the reel of material 110. The housing 12 or lid 24 may be provided with suitable cut-outs to accommodate the reel of material 100. The free end of the material 112, where it winds off the reel, is fed to the driving wheel 84 and maintained taut, so that it makes sufficient contact with the driving wheel 84, by biasing arm 27, which in this example is pivoted at one end to the housing 12 at the front of the device 10 and makes contact with the material 100 at the other end close behind the driving wheel 84. The device 10 could further include a tear-off feature adjacent the aperture 30 to aid the user in tearing off the material once a portion has been dispensed. For instance, a sharp or toothed edge 32 can be provided to help mechanically sever the material when the material is pulled down over the edge 30. Thus, the user can dispense tapes, ribbons, streamers, etc. by cranking the device and depressing the trigger as described above in relation to the example of FIG. 1.

The described example is a hand held device. However, the device could alternatively be adapted to rest on a table or other surface, or have attachment fixtures for attaching to any other desired object. The housing is therefore not constrained to having a handle, but can take many forms according to the application and desired type of use of the device.

Embodiments of the present invention have been described with particular reference to the example illustrated. However, it will be appreciated that variations and modifications may be made to the examples described within the scope of the present invention.

The invention claimed is:

1. A toy device for dispensing stackable or rollable materials, comprising:

a housing arranged to contain a stack or roll of material and having a dispensing aperture;

a manually actuated drive mechanism by which a user can rotate a drive wheel of the drive mechanism, the drive wheel being arranged to contact and, when rotated, to engage a portion of the material when contained in the housing so as to drive the material through the dispensing aperture to dispense it; and a release mechanism comprising a movable element having a first position where it prevents the material from being driven through the aperture and movable to a second position to allow the material to be driven through the aperture, and having an actuator linked to the movable element arranged to move the element between the first and second positions upon actuation by a user, wherein the drive mechanism can be actuated independently from the release mechanism;

wherein the drive wheel is movable between a position where it contacts the material and a position where it does not contact the material, wherein the release mechanism is further arranged to move the drive wheel by way of the actuator such that when actuated by the user the drive wheel is moved into contact with the material and the movable element is moved to the second position allowing the material to be dispensed; and wherein the drive mechanism comprises a gear casing pivotally mounted in the housing containing gearing that translates rotation of a hand crank to rotation of the drive wheel, wherein the release mechanism when actuated by the user is arranged to pivot the gear casing such that the drive wheel makes contact with the material.

2. The device of claim 1, wherein the gear casing is arranged to pivot about the axis about which the hand crank rotates.

3. The device of claim 1, wherein the drive wheel has a rubberised or high friction periphery for gripping the material.

4. The device of claim 1, wherein the device comprises an element for biasing a portion of the material against the driving wheel.

5. The device of claim 1, wherein the release mechanism comprises a lever pivotably attached relative to the housing, having the actuator fixed to one end of the lever at a position outside the housing and actuation and the movable element at the other end of the lever.

6. The device of claim 5, wherein the lever is arranged to also move the gear casing.

7. A toy device for dispensing stackable or rollable materials, comprising:

a housing arranged to contain a stack or roll of separate materials and having a dispensing aperture;

a manually actuated drive mechanism by which a user can rotate a drive wheel of the drive mechanism, the drive wheel being arranged to contact and, when rotated, to engage a portion of the material when contained in the housing so as to drive the material through the dispensing aperture to dispense it; and a release mechanism comprising a movable element having a first position where it prevents the material from being driven through the aperture and movable to a second position to allow the material to be driven through the aperture, and having an actuator linked to the movable element arranged to move the element between the first and second positions upon actuation by a user, wherein the drive mechanism comprises a hand crank or lever by which the user actuates the drive mechanism, and wherein the drive mechanism can be actuated by turning the hand crank independently from actuation of the release mechanism, such that the user can turn the hand crank at a desired speed before actuating the release mechanism to release the materials, allowing the materials to be dispensed at a desired rate.

8. The device of claim 7, wherein the drive mechanism comprises gearing to increase the speed of the drive wheel.

9. The device of claim 7, wherein the drive mechanism comprises a flywheel.

10. The device of claim 7, wherein the drive mechanism comprises a spring arranged to store energy upon user actuation of the drive mechanism and release the energy to the drive wheel.

11. The device of claim 7, comprising a tape or stack of material loaded within the housing, wherein the material is paper, card, plastics, foam or the like.

12. The device of claim 7, comprising an edge feature adjacent the aperture by which a dispensed portion of the material may be torn or cut.

13. The device of claim 7, wherein the drive mechanism comprises a slip clutch to prevent damage to the drive mechanism from overly forceful user actuation of the drive mechanism.

14. The device of claim 7, wherein the release mechanism is biased with the stop element in the first position, such that user actuation is required to move it to the second position and the biasing force returns it to the first position upon cessation of user actuation.

15. The device of claim 7, comprising an adaptor reversibly attached to the housing to position materials of a different size.

16. The device of claim 7, wherein the device has a lid, which is openable to allow access to the interior of the housing for loading a stack or roll of material to the device.

17. The device of claim 7, comprising an arm that biases the materials against the drive wheel.

18. A toy device for dispensing stackable or rollable materials, comprising:

a housing arranged to contain a stack or roll of material and having a dispensing aperture;

a manually actuated drive mechanism by which a user can rotate a drive wheel of the drive mechanism, the drive wheel being arranged to contact and, when rotated, to engage a portion of the material when contained in the housing so as to drive the material through the dispensing aperture to dispense it; and a release mechanism comprising a movable element having a first position where it prevents the material from being driven through the aperture and movable to a second position to allow the material to be driven through the aperture, and having an actuator linked to the movable element arranged to move the element between the first and second positions upon actuation by a user, wherein the drive mechanism can be actuated independently from the release mechanism;

wherein the housing comprises a handle and the actuator is positioned to be actuatable by a digit of the user's hand when holding the handle in that hand.

* * * * *